US005442127A

United States Patent [19]

Wachi et al.

[11] Patent Number: 5,442,127

[45] Date of Patent: Aug. 15, 1995

[54] WAVEFORM GENERATION DEVICE HAVING A MEMORY FOR STORING ADJACENT SAMPLE DATA IN DIFFERENT DATA COMPRESSION REPRESENTATIONS

[75] Inventors: Masatada Wachi; Masahiro Shimizu, both of Hamamatsu, Japan

[73] Assignee: Yamaha Corporation, Japan

[21] Appl. No.: 217,608

[22] Filed: Mar. 24, 1994

[30] Foreign Application Priority Data

Mar. 26, 1993 [JP] Japan ..... 5-068873

[51] Int. Cl.[6] ..... G10H 7/02; G10H 7/12

[52] U.S. Cl. ..... 84/603; 84/604; 84/607

[58] Field of Search ..... 84/603–607

[56] References Cited

FOREIGN PATENT DOCUMENTS 4-3556 1/1992 Japan .

*Primary Examiner*—Stanley J. Witkowski
*Attorney, Agent, or Firm*—Graham & James

[57] ABSTRACT

A memory stores waveform sample data for plural sample points forming a given tone waveform, and one of the stored waveform sample data stored for every two adjacent sample points is expressed in PCM representation while the other is in difference value representation that is based on the PCM values stored for two sample points on both sides of the sample point of the other sample data. The number of bits in each address of the memory is greater than the number of bits in each of the PCM data, and each of the PCM data is stored at some bit positions of one address, while the difference value data is stored at the remaining bit positions of one or more addresses. The waveform sample data stored in the memory are read out at a readout rate corresponding to a designated pitch and in the order of the sample points, but when at least the waveform sample data expressed in the difference value is read out, the PCM data stored for two sample points adjacent thereto are also read out along with the difference value data. The read-out difference data is reproductively demodulated into PCM representation, using the PCM data read out along with the difference data.

14 Claims, 6 Drawing Sheets

WAVEFORM GENERATION DEVICE HAVING A MEMORY FOR STORING ADJACENT SAMPLE DATA IN DIFFERENT DATA COMPRESSION REPRESENTATIONS

BACKGROUND OF THE INVENTION

This invention relates generally to waveform generation devices for use in electronic musical instruments, and it relates more particularly to waveform generation devices which generate a desired tone waveform by first storing, into waveform memory, tone waveform sample data in compressed form and then sequentially reading out the sample data from the waveform memory to perform predetermined operations on the sample data.

Among various waveform generation devices known today, there is a type which is generally arranged as follows. Namely, in such a waveform generation device, for every sample point of tone waveform data covering plural waveform cycles from start to end of tone generation, difference data indicative of an amplitude value difference between each adjacent pair of the sample points is expressed in floating point representation composed of mantissa and exponent data, and these difference data are stored at addresses of a waveform memory in correspondence to the sample points.

Then, once the pitch of a tone to be generated is designated via a keyboard, an address data generation circuit of the device generates address data sequentially changing at a rate corresponding to the designated tone pitch and provides the generated address data to the waveform memory. The waveform memory in turn sequentially reads out, from the addresses corresponding to the provided address data, the sample data composed of mantissa and exponent data.

After that, the mantissa and exponent data read out from the waveform memory are converted, by a floating-type digital-to-analog converter, from the floating point representation into analog real number values of the difference data. The thus-obtained real number values of the difference data are then accumulatively added or subtracted by an analog accumulator to provide analog tone waveform signals representative of waveform amplitude values for the respective sample points, which amplitude values are then supplied to a sound system to produce a tone.

The sample data compression as mentioned above is termed a floating-point-type differential pulse code modulation (DPCM). Such a waveform data compression technique using floating points is disclosed in Japanese Patent Publication No. HEI 4-3556 and U.S. Pat. No. 5,220,523.

However, because the above-mentioned prior art waveform generation device employs the floating-point-type DPCM to compress the sample data for storage in the waveform memory, there arises a problem that no tone waveform signal can be reproduced unless all the difference data for the respective adjacent pairs of samples points are sequentially read out and accumulatively added or subtracted by the analog accumulator.

Because of this arrangement, in order to produce a tone one octave higher than a currently produced tone, for example, the above-mentioned waveform generation device can not read out the sample data in a so-called "sample point skipped readout" fashion such as by advancing the waveform memory address to be accessed by two at a time. That is, with the device, a common set of the sample data can not be effectively employed for a wide pitch range, and it is of course impossible to reproduce only a selected part of the tone waveform signals.

SUMMARY OF THE INVENTION

It is therefore an object of the present invention to provide a waveform generation device which efficiently stores compressed waveform data in a memory to al low effective saving of storage capacity and efficient use of the memory and which also permits free data readout such as a sample point skipped readout and partial reproduction of a waveform.

In order to achieve the above-mentioned object, a waveform generation device in accordance with the present invention comprises a memory section for storing waveform sample data for plural sample points forming a given tone waveform, the waveform sample data for one plurality of the sample points being expressed in first data representation, the waveform sample data for another plurality of the sample points being expressed in second data representation which is more compressed data representation than the first data representation, the memory section including a storage area having plural addresses each of which is composed of a predetermined number of bits, the predetermined number of bits in each of the addresses being greater than the number of bits in each of the waveform sample data expressed in the first data representation, so that each of the waveform sample data expressed in the first data representation is stored at some bit positions of one of the addresses and each of the waveform sample data expressed in the second data representation being stored at remaining bit positions of one or more addresses, a read section for reading out the stored waveform sample data from the memory section, and a data reproduction section for converting the waveform sample data expressed in the second data representation that is read out by the read section, into the first data representation, so as to reproduce all the waveform sample data read out by the read section in the first data representation.

Since the second data representation is more compressed representation than the first data compression, the number of bits in the sample data in the second data representation is smaller than that in the sample data in the first data representation. Further, the number of bits in each sample data in the first data representation is smaller then the predetermined number of bits in each address of the memory section. Thus, when one sample data in the first data representation is stored at one address of the memory section, there occur some surplus bit positions at the address. So, in the present invention, the sample data in the second data representation is stored in the surplus bit positions of each address. This provides efficient use of the memory and can effectively save the memory storage capacity as a whole.

All the data to be stored in the memory are not compressed, and only the waveform sample data for one plurality of sample points forming a part of a given tone waveform are expressed in the compressed, i.e., second data representation. The data reproduction section does not have to perform any special reproduction process on the sample data expressed in the first data representation that is stored for the other plurality of sample points, and it only needs to perform a reproduction process to convert the sample data in the second data representation into the first data representation (i.e., demodulation). Thus, it may be possible to eliminate a need to prepare some accumulated data of previous sample values, when reproducing (or demodulating) the sample data expressed in the second data representation.

For example, in one embodiment of the present invention, one of that sample data stored for each of plural groups of adjacent plural sample points is expressed in the second data representation and the other of the sample data for each of said groups are expressed in the first data representation, the first data representation is PCM (Pulse Code Modulation) representation, and the second data representation for each of said groups is in a difference value that is based on an average of PCM values of the waveform sample data expressed in the first data representation for each of said groups, e.g. , the PCM data correspond to two sample points on both sides of the sample point of the sample data in the second representation, wherein the read section reads out the waveform sample data expressed in the first and second data representations, at a readout rate corresponding to a designated pitch and in the order of the sample points, and when reading at least the waveform sample data in the second data representation, the read section reads out, along with that waveform sample data, at least one of the waveform sample data expressed in the first data representation that are stored for two sample points on both sides of the sample point of the data in the second representation, and wherein the data reproduction section demodulates the waveform sample data expressed in the second data representation that is read out by the read section, into PCM representation, using the waveform sample data expressed in the first data representation that is read out therewith. With this arrangement, it is possible to eliminate the need to prepare some accumulated data of previous sample values, when reproducing (or demodulating) the sample data expressed in the second data representation. In addition, for producing a tone of a pitch one octave higher, it is allowed to freely read out the sample data from the memory while skipping every two or plural sample points (sample point skipped readout), and it is also possible to freely reproduce only a selected part of the tone waveform stored in the memory.

Now, the preferred embodiments of the present invention will be described in detail below with reference to the accompanying drawings.

DETAILED DESCRIPTION OF THE PREFERRED EMBODIMENTS

Figure 7:
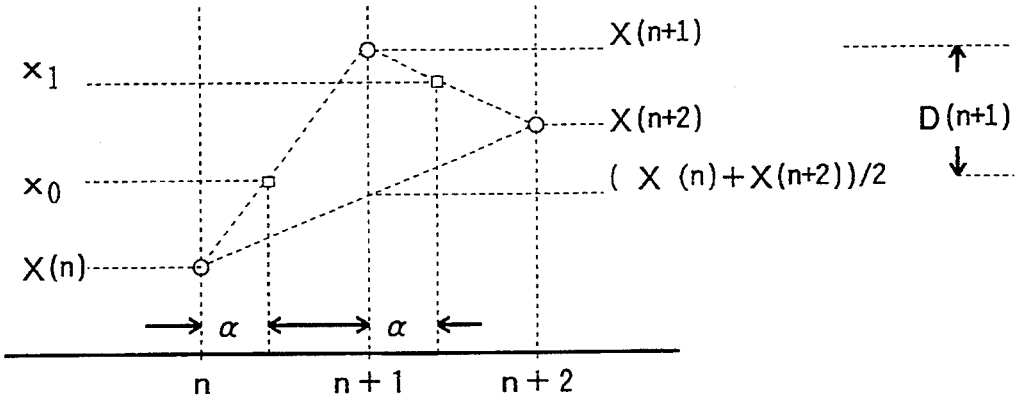
FIG. 7 is a diagram explanatory of the basic idea of the present invention.
Figure 8:
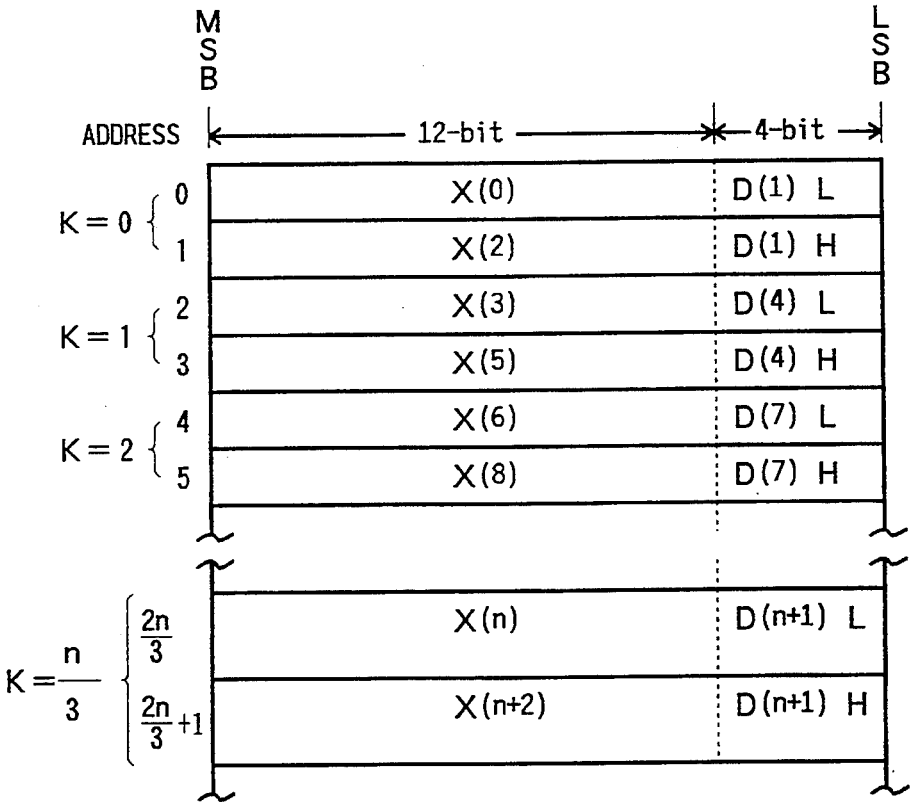
FIG. 8 is a diagram illustrating a case where sample data are stored into a waveform memory on the basis of the idea shown in FIG. 7.

Before going into a detailed description on embodiments of the present invention, a description will be given on the basic idea of the invention for providing a solution to the above-mentioned problems, in relation to FIGS. 7 and 8. For convenience of description, respective 12-bit sample data at nth sample point ($n=3k$; $k=0, 1, 2, \ldots$), $(n+1)$th sample point, $(n+2)$th sample point, . . . are designated as sample data $X(n)$, $X(n+1)$, $X(n+2)$, . . . respectively, as shown in FIG. 7. As shown in FIG. 8, sample data $X(n)$ and $X(n+2)$ are directly stored into a waveform memory without any change, at respective addresses $(2n/3)$ and $(2n/3+1)$ over 12-bit areas beginning from the respective MSBs.

Sample data $X(n+1)$, on the other hand, is not directly stored into the waveform memory. Instead, the average $\{(X(n)+X(n+2))/2\}$is subtracted from the sample data $X(n+1)$, and eight-bit data resultant from of the subtraction stored into the waveform memory as difference data $D(n+1)$. Namely, this difference data $D(n+1)$ can be represented by the following equation:

$$D(n+1) = X(n+1) - \frac{X(n+2) + X(n)}{2} \qquad \text{Equation (1)}$$

More specifically, as shown in FIG. 8, four-bit data $D(n+1)L$ beginning from the LSB of the difference data $D(n+1)$ is stored at address $(2n/3)$, i.e., four-bit area beginning from the LSB of the address storing sample data $X(n)$, and four-bit data $D(n+1)H$ beginning from the MSB of difference data $D(n+1)$ is stored at address $(2n/3+1)$, i.e., four-bit area beginning from the LSB of the address storing sample data $X(n+2)$. In the following description, data as stored at each address of the waveform memory will be referred to as memory data MD. It is to be appreciated that the storage area for data $D(n+1)L$ may be interchanged with the storage area for data $D(n+1)H$.

Sample data $X(n)$ and $X(n+2)$ are reproduced directly from the memory data MD, while sample data $X(n+1)$ is obtained by substituting sample data $X(n)$, $X(n+2)$ and difference data $D(n+1)$ retrieved from the memory data MD into the following equation (2) which is a modification of equation (1). Thus, sample data $X(n+1)$ is reproduced.

$$X(n+1) = D(n+1) + \frac{X(n+2) + X(n)}{2} \qquad \text{Equation (2)}$$

On the basis of the following equation (3), primary interpolations are performed for data $x_0$ between sample data $X(n)$ and $X(n+1)$, data $x_1$ between sample data $X(n+1)$ and $X(n+2)$, and data $x_2$ between sample data $X(n+2)$ and $X(n+3)$.

$$x = X(n+i) + \{X(n+i+1) - X(n+i)\} \times \alpha \qquad \text{Equation (3)}$$

In the above-mentioned equation (3), i represents one of 0, 1 and 2, and $\alpha$ represents an interpolating address data decimal section which defines an address interval between a waveform memory address where sample data immediately before the data to be interpolated is stored and a waveform memory address where the data to be interpolated is anticipated to be stored.

The data $x_0$ between sample data X(n) and X(n+1) is obtained from the following equation (4) which is obtained by substituting i=0 and equation (2) into equation (3). The operation mode for such an interpolation of the data $x_0$ will hereinafter be referred to as interpolation mode 0.

$$x_0 = X(n) + \{X(n+1) - X(n)\} \times a \qquad \text{Equation (4)}$$

$$= X(n) + \left\{ D(n+1) + \frac{X(n+2) + X(n)}{2} - X(n) \right\} \times a$$

$$= X(n) + \left\{ D(n+1) + \frac{X(n+2) - X(n)}{2} \right\} \times a$$

Further, the data $x_1$ between sample data X(n+1) and X(n+2) is obtained from the following equation (5) which is obtained by substituting i=1 and equation (2) into equation (3). The operation mode for such an interpolation of the data $x_1$ will hereinafter be referred to as interpolation mode 1.

$$x_1 = X(n+1) + \{X(n+2) - X(n+1)\} \times a \qquad \text{Equation (5)}$$

$$= D(n+1) + \frac{X(n+2) + X(n)}{2} - \left\{ D(n+1) + \frac{X(n+2) - X(n)}{2} \right\} \times a$$

$$= X(n+2) + \left\{ D(n+1) - \frac{X(n+2) - X(n)}{2} \right\} \times (1 - a)$$

Further, the data $x_2$ between sample data X(n+2) and X(n+3) is obtained from the following equation (6) which is obtained by substituting i=2 into equation (3). The operation mode for such an interpolation of the data $x_2$ will hereinafter be referred to as interpolation mode 2.

$$x_2 = X(n+2) + \{X(n+3) - X(n+2)\} \times \alpha \qquad \text{Equation (6)}$$

Without requiring accumulative addition or subtraction of the difference data as in the prior art, storing and reading the sample data into and from the waveform memory in the above-mentioned manner make it possible to reproduce only a part of the stored waveform and to also perform primary interpolations between the sample data, by only reading out 32-bit memory data MD stored at adjacent waveform addresses and then substituting the read-out data into the above-mentioned equations (2) and (4) to (6).

Figure 1:
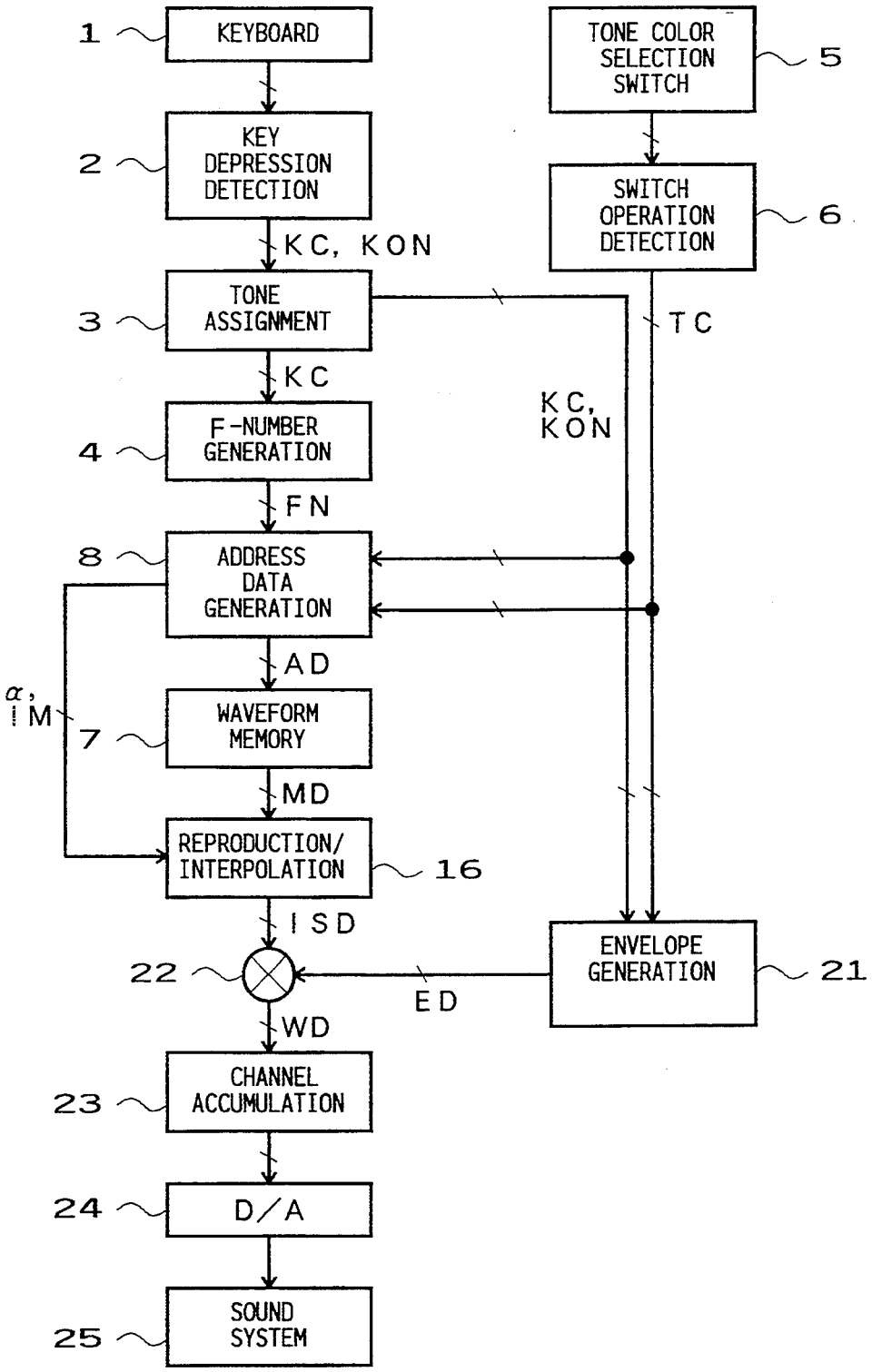
FIG. 1 is a block diagram illustrating the general structure of an electronic musical instrument to which is applied a waveform generation device in accordance with a first embodiment of the present invention.

Now, the embodiments of the invention will be described with reference to the drawings. FIG. 1 is a block diagram of an electronic musical instrument to which is applied a waveform generation device in accordance with a first embodiment of the present invention. The electronic musical instrument as illustrated comprises a keyboard 1 including a plurality of keys, and a key depression detection circuit 2 for detecting a key depression on the keyboard 1. Upon detection of a key depression, the detection circuit 2 outputs a key code KC corresponding to the depressed key and also keeps outputting a key-on signal KON while the key is depressed by the player.

In this embodiment, 16 tone generation channels are provided, and there are allotted respective time slots for the tone generation channels. A tone assignment circuit 3 is provided for assigning a key code KC and key-on signal KON received from the key depression detection circuit 2 to any of the 16 tone generation channels and outputs the key code KC and key-on signal KON in accordance with the timing of the time slots allotted to the channels.

An F-number generation circuit 4 stores as many numerical values (F numbers) as the number of the keys on the keyboard 1, and the numerical values correspond to pitch-determining frequencies of the keys. The F-number generation circuit 4 converts the key code KC into an F number corresponding to the depressed key and outputs the F number in accordance with the time slot timing.

A tone color selection switch 5 is provided for selecting a desired tone color from among preset tone colors of piano, guitar, organ etc. A switch operation detection circuit 6 detects an operation of the tone color selection switch 5 and outputs a tone color number TC corresponding to a tone color selected by the switch 5.

In a waveform memory 7, there are stored a plurality of memory data MD corresponding to the respective tone colors. Each of the memory data MD has been placed in compressed form by the sample data compression method as previously mentioned in relation to FIGS. 7 and 8 and comprises the sample data SD and difference data of waveform attack portion and subsequent repetition portion. An address data generation circuit 8 generates address data AD and the like for reading out memory data MD corresponding to a selected tone color.

Figure 2:
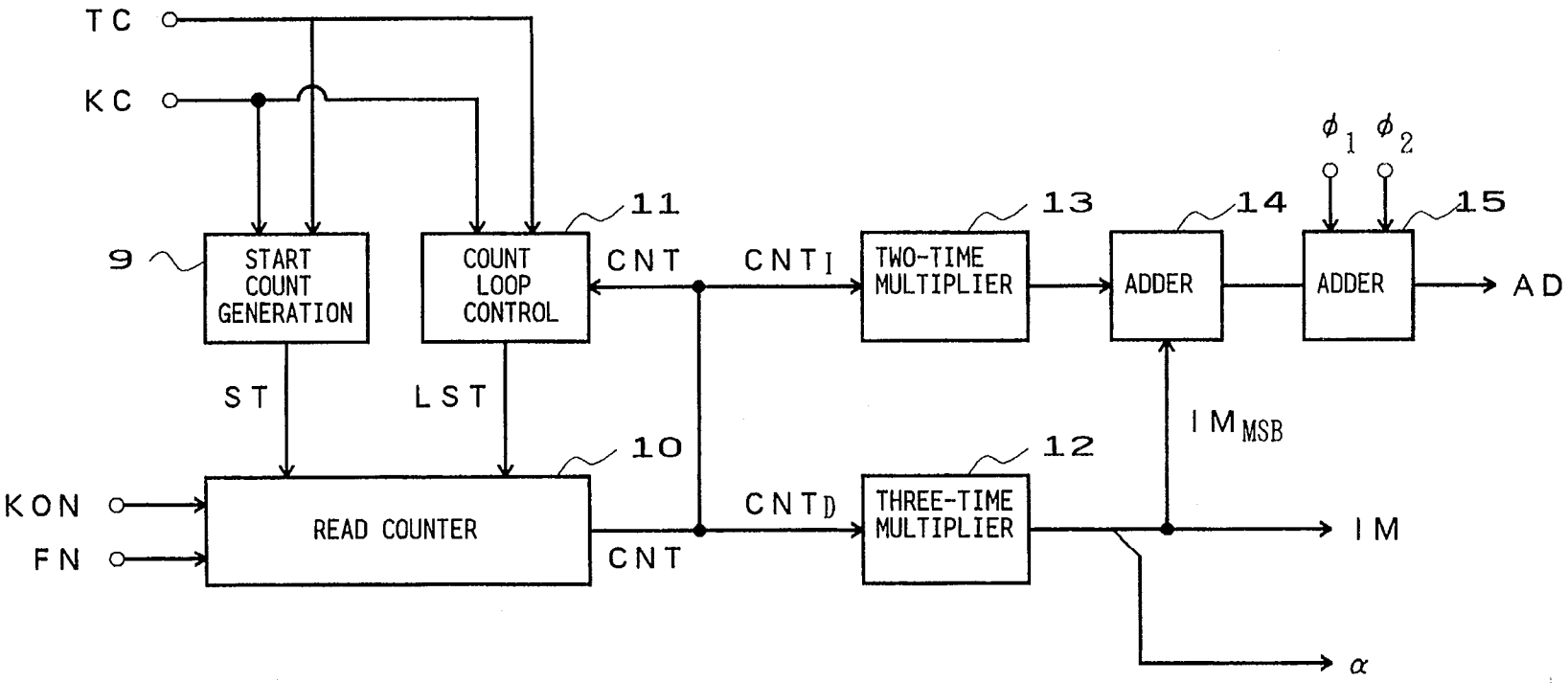
FIG. 2 is a block diagram illustrating an example structure of an address data generation circuit shown in FIG. 1.

Now referring to FIG. 2, the structure of the address data generation circuit 8 is illustrated in a block diagram. In this figure, a start count generation circuit 9 provides a start count ST at which a read counter 10 should start counting, in accordance with a key code KC and tone color number TC. Once a key-on signal KON is received, the read counter 10 starts counting from the start count ST provided from the start count generation circuit 9 and outputs a series of count values CNT that increment by a value of the F-number per count.

In accordance with the key code KC and tone color number TC, a count-loop control circuit 11 determines a start count LST indicative of a start point of a count loop to be repeated and an end count LEN. The count-loop control circuit 11 constantly monitors the count values CNT, and it sets the start count LST into the read counter 10 when the count value CNT has been counted up to the end count LEN. Thus, the read counter 10 restarts counting up from the start count LST.

The reason for such a count loop arrangement is that, in this embodiment, the waveform memory 7 stores sample data SD of waveform attack and subsequent repetition portions as mentioned earlier.

A three-times multiplier 12 multiplies the decimal section $CNT_D$ of the count value CNT three-fold, and it outputs the integer section of the multiplication result as two-bit interpolation mode data 1M (1M=00, 01, 10)

designating one of the interpolation modes 0–2 and also outputs the decimal section of the multiplication result as the above-mentioned interpolating address data decimal section $\alpha$.

A two-times multiplier 13 multiplies the integer section $CNT_I$ two-fold and provides the multiplication result to an adder 14. Only when the most significant bit $IM_{MSB}$ of the interpolation mode data IM is "1", the adder 14 adds "1" to the multiplication result of the two-times multiplier 13. An adder 15 receives clock pulses $\phi_1$ and $\phi_2$ shown in FIG. 3, and the adder 15 adds "1" to the addition result of the adder 14 at the rise timing of clock pulse $\phi_1$ and outputs its addition result to the waveform memory 7 as address data AD.

Figure 3:
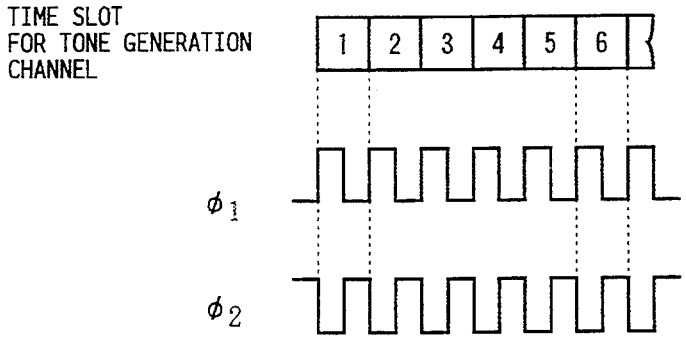
FIG. 3 is a time chart illustrating an example of timing relationship between time slots for tone generation channels and clock pulses.

Consequently, memory data MD comprising sample data SD and difference data corresponding to the tone color designated by the tone color number TC are read out from an address of the waveform memory 7 designated by the address data AD. FIG. 3 also shows time slots corresponding to the plural tone generation channels. For each of the tone generation channels, 32-bit memory data MD stored at two adjacent addresses are time-divisionally read out from the waveform memory 7 at the timings of clock pulses $\phi_1$ and $\phi_2$.

Figure 4:
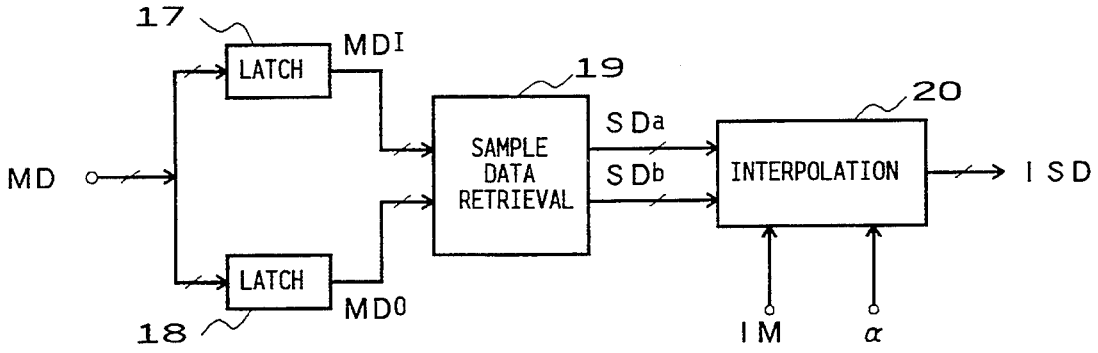
FIG. 4 is a block diagram illustrating an example structure of a reproduction/interpolation circuit shown in FIG. 1.

Referring back to FIG. 1, a reproduction/interpolation circuit 16 is provided for reproducing sample data SD from the memory data MD read out from the waveform memory 7 and for interpolating between the sample data in accordance with the interpolation mode 0, 1 or 2. In FIG. 4, there is shown the structure of the reproduction/interpolation circuit 16 in a block diagram. In this figure, a latch 17, at the timing of clock pulses $\phi_1$, temporarily holds the memory data $MD_1$ stored at the address of the waveform memory 7 designated by the address data AD. A latch 18, at the timing of clock pulse $\phi_2$, temporarily holds the memory data $MD_0$ stored at the address of the waveform memory 7 designated by the address data AD.

From the memory data $MD_1$ and $MD_0$ and on the basis of the above-mentioned equation (2), a sample data retrieval circuit 19 retrieves sample data $SD_a$ and $SD_b$ and supplies the sample data $SD_a$ and $SD_b$ to an interpolation circuit 20. The interpolation circuit 20 performs primary linear interpolation on the sample data on the basis of the sample data $SD_a$ and $SD_b$, interpolation mode data IM, interpolating address data decimal section $\alpha$ and above-mentioned equations (4) to (6), so as to provide interpolated sample data ISD.

Further in FIG. 1, in response to the key-on signal KON, an envelope generation circuit 21 generates envelope data ED of a waveform of the type as designated by the key code KC and tone color number TC. A multiplier 22 multiplies the interpolated sample data ISD by the envelope data ED to provide tone waveform data WD. A channel accumulation circuit 23 accumulates the tone waveform data WD of the tone generation channels and outputs the accumulated tone waveform data.

A D/A converter 24 converts the accumulated tone waveform data of the tone generation channels into analog tone waveform signal. A sound system 25 amplifies the tone waveform signal to audibly reproduce a tone after having filtered out unnecessary noises from the waveform signal and/or having applied effect imparting processing to the waveform signal as needed.

Of various components so far described, the waveform memory 7, address data generation circuit 8 and reproduction/interpolation circuit 16 constitute the waveform generation device of the present invention.

Figure 5:
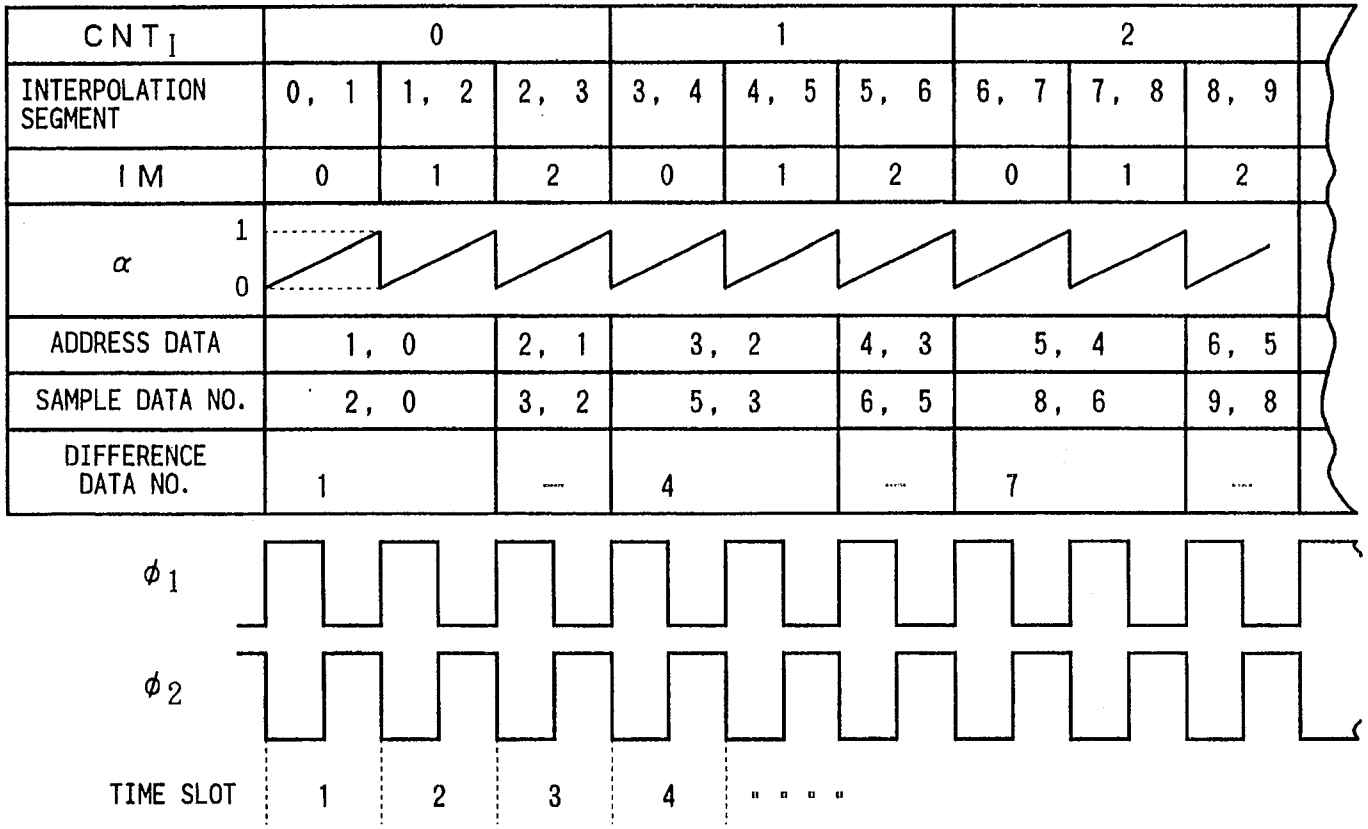
FIG. 5 is a diagram illustrating an example operation of the wave form generation device in accordance with the first embodiment.

Next, with reference to a timing chart of FIG. 5, a description will be given below on the operation of the electronic musical instrument according to the first embodiment. For ease of explanation, the timing chart of FIG. 5 is shown as if processes in each tone generation channel are continuously executed, but in effect, processes in 16 tone generation channels are executed on a time-divisional basis at the timing of the corresponding time slots. Accordingly, in a single time slot, process is executed for one of interpolation segments shown in FIG. 5, depending on the changing output count value CNT of the counter 10.

When, for example, the player operates the tone color selection switch 5 to select the piano tone color, the operation detection circuit 6 detects such an operation of the selection switch 5 and outputs a tone color number TC corresponding to the piano tone color. Then, when the player depresses a key on the keyboard which corresponds to scale note $C_4$, the key depression detection circuit 2 detects such a depression of the $C_4$ key on the keyboard 1 to provide the tone assignment circuit 3 with a key code KC corresponding to the depressed key and keeps providing the tone assignment circuit 3 with a key-on signal KON while the key is depressed by the player.

Thus, the tone assignment circuit 3 assigns the key code KC corresponding to the $C_4$ key and the key-on signal KON to one of the 16 tone generation channels, and it time-divisionally outputs the key code KC and key-on signal KON at the timing of the time slot allotted to the generation channel. It is assumed here that no tone is currently being sounded in any of the tone generation channels and that the key code KC and key-on signal KON corresponding to the $C_4$ key are assigned to tone generation channel 1 and are time-divisionally output at the timing of the time slot allotted to tone generation channel 1.

Then, the F-number generation circuit 4 converts the key code KC corresponding to the $C_4$ key into a corresponding F number and outputs the F-number FN at the timing of the time slot allotted to tone generation channel 1. It is further assumed here that the F-number FN is "1".

Thus, in the address data generation circuit 8, the start count generation circuit 9 provides a start count ST indicating a start point for the read counter 10 to start counting. In this case, the start count ST indicates the lead address of an area in the waveform memory 7 which stores memory data MD corresponding to the piano tone color. It is further assumed here that the memory data MD corresponding to the piano tone color are stored sequentially from address 0. Therefore, the start count ST will be "0.0000" (in this embodiment, the decimal portion $CNT_D$ of the count value CNT has four decimal places, for example).

In practice, the waveform memory 7 previously stores tone waveform data for each tone color and for each tone pitch range (for example, for each two-octave tone pitch range), so that the tone waveform data corresponding to the tone color and tone pitch range as dictated by the tone color TC and key code KC are designated for required readout. This designation is made possible by setting the start count ST, and count-loop start and end counts LST and LEN.

However, for convenience of explanation, this embodiment will be described on the assumption that the waveform memory 7 stores tone waveform data which are common to all tone pitch ranges and only correspond to the tone colors.

Thus, at the input timing of the key-on signal KON, the start count ST ("0.0000") output from the start count generation circuit 9 is set into the read counter 10, so that the counter 10 starts counting from the start count ST ("0.0000") and provides the output count value CNT which is counted up by the value of the F-number FN ("1") per count.

This causes the integer section $CTN_I$ of the output count value CNT to be counted up from 0 to 1, 2, . . . as shown in FIG. 5.

Further, in this case, start count LST and end count LEN of a count loop corresponding to the piano tone color are set into the count-loop control circuit 11 in accordance with the tone color number TC. The count-loop control circuit 11 then constantly monitors the count values CNT and sets the start count LST into the read counter 10 when the output count value CNT has been counted up to the end count LEN. This allows the read counter 10 to restart counting up from the start count LST.

The three-times multiplier 12 multiples the decimal section $CNT_D$ (i.e., a certain value within a range of 0.0001–0.9999) of the output count value CNT three-fold, and, as shown in FIG. 5, it outputs the integer section (0, 1 or 2) of the multiplication result (i.e., a certain value within a range of 0.0003–2.9997) as two-bit interpolation mode data IM (IM is one of two-bit binary values "00", "01" and "10") designating one of interpolation modes 1 to 2 and also outputs the decimal section (i.e., a certain value within a range of 0.0003–0.9997) of the multiplication result as the interpolating address data decimal section $\alpha$. Thus, generally in response to the change in the output count value CNT, the interpolation mode changes in the order of 0, 1, 2.

On the other hand, the two-times multiplier 13 multiplies the integer section $CNT_I$ (i.e., one of values 0, 1 and 2) of the output count value CNT two-fold and provides the multiplication result (i.e., one of values 0, 2 and 4) to the multiplier 14. In turn, only when the most significant bit $IM_{MSB}$ is "1", i.e., only in interpolation mode 2, the adder 14 adds "1" to the multiplication result of the two-times multiplier 13. Because of this, addition results which change like 0, 0, 1, 2, 2, 3, 4, 4, 5, . . . are sequentially output from the adder 14, in response to the repetitive change in the interpolation mode IM.

The adder 15 receives clock pulses $\phi_1$ and $\phi_2$ as shown in FIG. 3, so that at the rise timing of clock pulse $\phi_1$ it adds "1" to the addition result (0, 0, 1, 2, 2, 3, 4, 4, 5 . . . ) of the adder 14 and then supplies the addition result (1, 0, 1, 0, 2, 1, 3, 2, 3, 2, 4, 3, 5, 4, 5, 4, 6, 5, . . . ) to the waveform memory 7 as the address data AD.

In this way, memory data MD comprised of the sample data SD and difference data of the piano tone color designated by the tone color number TC and are read out from addresses of the waveform memory 7 designated by the address data AD (1, 0, 1, 0, 2, 1, 3, 2, 3, 2, 4, 3, 5, 4, 5, 4, 6, 5, . . . ).

Namely, as shown in FIG. 5, in first and second time slots, memory data MD composed of sample data SD (sample data x(2)) of sample data No. 2 and difference data D(1)H of difference data No. 1 stored at address 1 of the waveform memory 7, and memory data MD composed of sample data SD (sample data x(0)) of sample data No. 0 and difference data D(1)L of difference data No. 1 stored at address 0 of the waveform memory 7 are read out in a sequential manner.

Then, in a third time slot, memory data MD composed of sample data SD (sample data x(3)) of sample data No. 3 and difference data D(4)L of difference data No. 4 stored at address 2 of the waveform memory 7, and memory data MD composed of sample data SD (sample data x(2)) of sample data No. 2 and difference data D(1)H of difference data No. 1 stored at address 1 of the waveform memory 7 are read out in a sequential manner.

After that, in the reproduction/interpolation circuit 16, the latch 17, at the clock pulse $\phi_1$ timing in the first time slot, temporarily holds memory data $MD_1$ which is stored at the address of the waveform memory 7 designated by the address data AD and which is, in this case, composed of the sample data x(2) and difference data D(1)H stored at address 1 of the waveform memory 7.

On the other hand, the latch 18, at the clock pulse $\phi_2$ timing in the first time slot, temporarily holds memory data $MD_0$ which is stored at the address of the waveform memory 7 designated by the address data AD and which is, in this case, composed of the sample data x(0) and difference data D(1)L stored at address 0 of the waveform memory 7.

Subsequently, on the basis of the memory data $MD_1$ and $MD_0$ temporarily held in the latches 17 and 18 and on the basis of the above-mention equation (2), the sample data retrieval circuit 19 retrieves sample data SDa and SDb (which are, in this case, sample data x(0) and x(1)) and supplies the retrieved data to the interpolation circuit 20.

Then, on the basis of the supplied sample data $SD_a$ and $SD_b$ (which are, in this case, sample data x(0) and x(1)), interpolation mode data IM (which is "0" in this case) and interpolating address data decimal section $\alpha$ as well as the above-mentioned equation (4), the interpolation circuit 20 performs a primary interpolation for data $x_0$ between sample data X(0) and X(1) and thus provides interpolated sample data ISD.

Next, in the second time slot of tone generation channel 1, the latch 17 of the reproduction/interpolation circuit 16, at the clock pulse $\phi_1$ timing, temporarily holds the memory data MD which is composed of sample data x(2) and difference data D(1)H stored at address 1 of the waveform memory 7, as with the first time slot of tone generation channel 1.

Also, the latch 18, at the clock pulse $\phi_2$ timing in the second time slot, temporarily holds the memory data MD which is, in this case, composed of the sample data x(0) and difference data D(1)L stored at address 0 of the waveform memory 7, as with the first time slot.

Subsequently, on the basis of the two memory data MD temporarily held in the latches 17 and 18 and on the basis of the above-mention equation (2), the sample data retrieval circuit 19 retrieves sample data x(1) and x(2) and supplies the retrieved data to the interpolation circuit 20.

Then, on the basis of the supplied sample data x(1) and x(2), interpolation mode data IM (which is "1" in this case) and interpolating address data decimal section $\alpha$ as well as the above-mentioned equation (5), the interpolation circuit 20 performs a primary interpolation for data $x_1$ between sample data X(1) and X(2) so as to provide interpolated sample data ISD.

Next, in the third time slot of tone generation channel 1, the latch 17 of the reproduction/interpolation circuit 16, at the clock pulse $\phi_1$ timing, temporarily holds memory data MD which is, in this case, composed of sample data x(3) and difference data D(4)L stored at address 2 of the waveform memory 7.

Also, the latch 18, at the clock pulse $\phi_2$ timing in the second time slot, temporarily holds memory data MD stored which is, in this case, composed of sample data x(2) and difference data D(1)H stored at address 1 of the waveform memory 7.

Subsequently, on the basis of the two memory data MD temporarily held in the latches 17 and 18 and on the basis of the above-mention equation (2), the sample data retrieval circuit 19 retrieves sample data x(2) and x(3) and supplies the retrieved data to the interpolation circuit 20.

Thus, on the basis of the supplied sample data x(2) and x(3), interpolation mode data IM (which is "2" in this case) and interpolating address data decimal section $\alpha$ as well as the above-mentioned equation (6), the interpolation circuit 20 performs a primary interpolation for data $x_2$ between sample data X(2) and X(3) so as to provide interpolated sample data ISD.

In the above-described manner, the interpolation operation is time-divisionally performed for the respective time slots of tone generation channels 1–16.

Then, at the timing of the key-on signal KON, the envelope generation circuit 21 generates envelope data ED of an envelope waveform of a type designated by the key code KC and tone color number TC, for each of tone generation channels 1–16. The multiplier 22 in turn multiplies the interpolated sample data ISD by the envelope data ED to provide tone waveform data WD, and the channel accumulation circuit 23 in turn accumulates the respective tone waveform data WD of tone generation channels 1–16.

The accumulated tone waveform data WD are provided to the D/A converter 24, where they are converted to analog tone waveform signal. The sound system 25 performs filtering and/or tonal effect imparting processes on such analog tone waveform signal of tone generation channels 1–16 in order to eliminate unnecessary noises and to impart desired tonal effect. The resultant tone signals are then audibly sounded through speakers of the sound system 25.

Further, if the player depresses a key on the keyboard 1 corresponding to scale note $C_5$, i.e., a key one octave higher than the $C_4$ key, with the tone color switch 5 set for the piano tone color, the key depression detection circuit 2 detects such a depression of the $C_5$ key on the keyboard 1 so as to provide the tone assignment circuit 3 with a key code KC corresponding to the depressed key and keeps providing the tone assignment circuit 3 with a key-on signal KON while the key is depressed by the player.

Thus, the tone assignment circuit 3 assigns the key code KC corresponding to scale note $C_5$ and the key-on signal KON to one of the 16 tone generation channels, and it time-divisionally outputs the key code KC and key-on signal KON at the timing of the time slot allotted to the tone generation channel. It is assumed here that the key code KC and key-on signal KON corresponding to scale note $C_4$ are assigned to tone generation channel 1 and that the key code KC and key-on signal KON corresponding to scale note $C_5$ are assigned to tone generation channel 2 are time-divisionally output at the timing of the time slot allotted to tone generation channel 2.

Then, the F-number generation circuit 4 converts the key code KC corresponding to scale note $C_5$ into a corresponding F number FN and outputs the F number FN at the timing of the time slot allotted to tone generation channel 2. Since, in this case, the F-number for scale note $C_4$ has been set as "1", the F-number for scale note $C_5$ is "2".

Thus, in accordance with the tone color number TC corresponding to the piano tone color, the start count generation circuit 9 of the address data generation circuit 8 provides a start count ST indicating a start point for the read counter 10 to start counting. Therefore, similarly to the above-mentioned, the start count ST will be "0.0000".

Thus, at the input timing of the key-on signal KON, the start count ST ("0.0000") output from the start count generation circuit 9 is set into the read counter 10, so that the counter 10 starts counting from the start count ST ("0.0000") and provides the output count value CNT which is counted up by the value of the F number FN ("2") for each count.

This causes the integer section $CTN_I$ of the output count value CNT to be counted up from 0 to 0, 2, 4 . . . , and the address data generation circuit 8 and reproduction/interpolation circuit 16 perform operations as when the player depressed the $c_4$ key on the 1, except for operations executed when the integer section $CTN_I$ is 1, 3, 5, . . . .

Now, a brief description will be given below only on the characteristic features of the above-mentioned operation.

First, the two-times multiplier 13 multiplies the integer section $CNT_I$(0, 2, 4, . . . ) of the output count value CNT two-fold and provides the multiplication results (0, 4, 8, . . . ) to the multiplier 14. Thus, only when the most significant bit $IM_{MSB}$ of the interpolation mode data is "1", i.e., only in interpolation mode 2, the adder 14 adds "1" to the multiplication results (0, 4, 8, . . . ) of the two-time multiplier 13. Because of this, addition results (0, 0, 1, 4, 4, 5, 8, 8, 9, . . . ) will be sequentially output from the adder 14.

The adder 15 receives clock pulses $\phi_1$ and $\phi_2$ as shown in FIG. 3, so that at the rise timing of clock pulse $\phi_1$ it adds "1" to the addition result (0, 0, 1, 4, 4, 5, 8, 8, 9, . . . ) of the adder 14 and then supplies the added result (1, 0, 1, 0, 2, 1, 5, 4, 5, 4, 6, 5, 9, 8, 9. 8, 10, 9, . . . ) to the waveform memory 7 as the address data AD.

In this way, memory data MD that are comprised of sample data SD and difference data of the piano tone color designated by the tone color number TC are read out from addresses of the waveform memory 7 designated by the address data AD (1, 0, 1, 0, 2, 1, 5, 4, 5, 4, 6, 5, 9, 8, 9, 8, 10, 9, . . . ).

Thus, in accordance with the first embodiment, "sample-point-skipped readout" of sample data, which could never be achieved by the prior art waveform generation device, is achieved such that, in order to generate a tone one octave higher than a currently-generated tone, sample data stored in the waveform memory are read out by incrementing the waveform address by two at a time.

Figure 6:
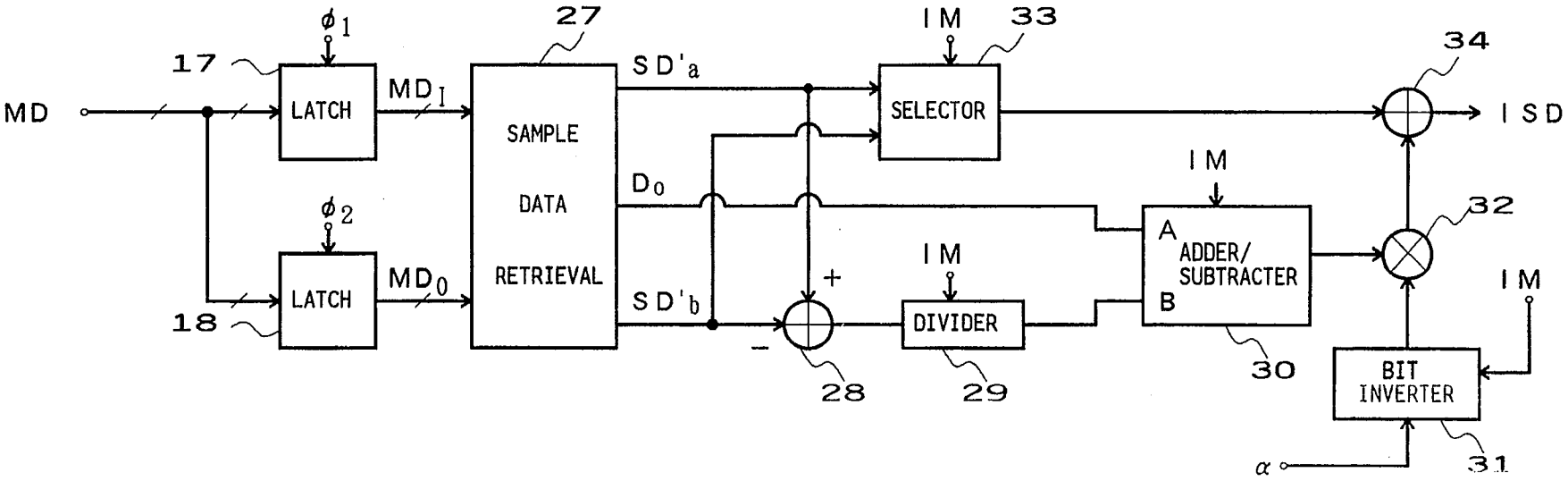
FIG. 6 is a block diagram illustrating an example structure of a reproduction/interpolation circuit employed in a waveform generation device in accordance with a second embodiment of the present invention.

Next, a description will be given on a waveform generation device in accordance with a second embodiment of the present invention. Components in the second embodiment are the same as in the first embodiment, except for a reproduction/interpolation circuit 26. FIG. 6 is a block diagram of the reproduction/interpolation circuit 26 that is employed in the waveform generation device. Components corresponding to those in FIG. 4 are represented by same reference characters as in FIG. 4 and will not be described here to avoid unnecessary duplication.

A sample data retrieval circuit 27 retrieves the respective upper 12 bits (i.e., 12 bits from the respective MSBs) of data $MD_1$ and $MD_0$ that are temporarily held in latches 17 and 18, as sample data $SD'_a$ and $SD'_b$. The sample data retrieval circuit 27 also retrieves the respective lower 4 bits (i.e., 4 bits from the respective LSBs) of data $MD_1$ and $MD_0$ that are temporarily held in latches 17 and 18, as difference data $D_D$.

A subtracter 28 subtracts sample data $SD'_b$ from sample data $SD'_a$. If interpolation mode data IM is "00" or "01", a divider 29 divides the subtraction result of the subtracter 28 by two (to right-shift the binary data). If, however, the interpolation mode data IM is "10", the divider 29 outputs the subtraction result of the subtracter 28 directly without such a division.

If interpolation mode data IM is "00", an adder/subtracter circuit 30 adds difference data $D_D$ received at its A input with the result of the divider 29 received at its B input. If, however, the interpolation mode data IM is "01", the adder/subtracter circuit 30 subtracts the result of the divider 29 received at its B input from the difference data $D_D$ received at its A input. Further, if the interpolation mode data IM is "10", the adder/subtracter circuit 30 only outputs the result of the divider 29 received at its B input directly without any change.

bit inverter 31 outputs the decimal section $\alpha$ of interpolating address data directly as received if the interpolation mode data IM is "00" or "10". But, if the interpolation mode data IM is "01", the bit inverter 31 bit-inverts the binary decimal section $\alpha$ of the interpolating address data so as to provide $(1-\alpha)$. A multiplier 32 multiplies the operation result of the adder/subtracter circuit 30 by the output of the bit inverter 31.

A selector 33 selects the sample data $SD'_b$ received at its B input if the interpolation mode data IM is "00" or "10", but it selects the sample data $SD'_a$ if the interpolation mode data IM is "01". An adder 34 adds the output of the selector 33 with the operation result of the multiplier 32 so as to provide the addition result as interpolated sample data ISD.

The above-described components 28 to 34 thus implement equations (4) to (6) mentioned earlier. The operation of this second embodiment is similar to the first embodiment and therefore will not be described here.

In accordance with each of the first and second embodiments, without the need for adding or subtracting the difference data as in the past, it is possible to reproduce a part of a desired tone waveform and also perform primary interpolation between sample data, by only reading out 32-bit memory data stored at adjacent addresses of the waveform memory and then substituting the read-out memory data into the above-mentioned equations (2) and (4) to (6).

Further, in accordance with each of the first and second embodiments, because of the arrangements that sample data X(n) and X(n+2) are directly stored into the waveform memory, and the average $\{(X(n)+X(n+2))/2\}$ between sample data X(n) and X(n+2) is subtracted from the sample data X(n+1) and eight bits of the subtraction result is stored into the waveform memory as difference data D(n+1), it is possible to conveniently store, in the waveform memory, waveform data such as tone waveform data that contains not so many of frequency components in the vicinity of a frequency band corresponding to a half of the sampling frequency.

It should be appreciated that the present invention is not constrained to the specific structures of the embodiments so far described, and various modifications are possible without departing from the spirit of the present invention.

For example, although, in the first and second embodiments described above, sample data X(n) and X(n+2) are each 12-bit data and difference data D(n+1) is 8-bit data, the number of bits of these data may be varied so as to be optimum depending upon a tone color selected. However, because of the need to compress data, the number of bits of difference data D(n+1) is made smaller than that of sample data X(n) or X(n+2).

In accordance with the present invention thus far described, it is allowed to freely read out the sample data while skipping addresses to be accessed (a sample-point-skipped readout), and it is also possible to freely reproduce only a part of tone waveform stored in the memory.

What is claimed is:

1. A waveform generation device comprising:

memory means for storing waveform sample data for plural sample points forming a given tone waveform, the waveform sample data for one plurality of the sample points being expressed in first data representation, the waveform sample data for another plurality of the sample points being expressed in second data representation which is more compressed data representation than said first data representation, said memory means including a storage area having plural addresses each of which is composed of a predetermined number of bits, the predetermined number of bits in each of said addresses being greater than the number of bits in each of said waveform sample data expressed in said first data representation, so that each of the waveform sample data expressed in the first data representation is stored at some bit positions of one of the addresses and each of the waveform sample data expressed in the second data representation is stored at remaining bit positions of one or more addresses;

read means for reading out the stored waveform sample data from said memory means; and data reproduction means for converting the waveform sample data expressed in said second data representation that is read out by said read means, into the first data representation, so as to reproduce all the waveform sample data read out by said read means in said first data representation.

2. A waveform generation device as defined in claim 1 wherein said first data representation is PCM (Pulse Code Modulation) representation, and said second data representation is difference data representation.

3. A waveform generation device as defined in claim 1 wherein one of the sample data stored for two adjacent sample points is expressed in said first data representation, and another of the sample data is expressed in said second data representation.

4. A waveform generation device as defined in claim 3 wherein each of the waveform sample data expressed in said second data representation is expressed as a difference value that is based on a PCM value of at least one of the waveform sample data expressed in said first data representation that are stored for the sample point adjacent to the sample point of said waveform sample data expressed in said second data representation.

5. A waveform generation device as defined in claim 1 wherein one of the sample data stored for every plural adjacent sample points is expressed in said second data representation, and the other of the sample data stored for said adjacent sample points is expressed in said first data representation.

6. A waveform generation device as defined in claim 5 wherein each of the waveform sample data expressed in said second data representation is in a difference value that is based on an average of PCM values of the waveform sample data expressed in said first data representation that are stored for two sample points adjacent to the sample point of said waveform sample data expressed in said second data representation.

7. A waveform generation device as defined in claim wherein the number of bits in each of said waveform sample data expressed in said first data expression is greater than a half of the predetermined number of bits in each of said addresses.

8. A waveform generation device as defined in claim 1 wherein the number of bits in each of said waveform sample data expressed in said second data expression is divided in halves, and the halves of said data are stored at the remaining bit positions of two said addresses, respectively.

9. A waveform generation device as defined in claim 8 wherein the predetermined number a of bits in each of said addresses and the number b of bits in each of said sample data expressed in said first data representation is in such a relationship that two times a is smaller than three times b (i.e., "$2a < 3b$") and the number c of bits in each of said waveform sample data expressed in said second data representation is equal to or less than two times (a−b) (i.e., "$c \leqq 2(a-b)$").

10. A waveform generation device as defined in claim 1 wherein said data reproduction means includes means for interpolating between the reproduced waveform sample data.

11. A waveform generation device as defined in claim 1 wherein one of the sample data stored for each group of plural adjacent sample points is expressed in said second data representation and the other of the sample data for said group is expressed in said first data representation, said first data representation is PCM (Pulse Code Modulation) representation, and the waveform sample data expressed in said second data representation for each said group is expressed as a difference value that is based on a PCM value of at least predetermined one of the waveform sample data expressed in said first data representation for said group, wherein said read means reads out the waveform sample data expressed in said first and second data representations, at a readout rate corresponding to a designated pitch and in an order of the sample points, and when reading at least the waveform sample data expressed in said second data representation for each said group, said read means reads out, along with that waveform sample data, said at least predetermined one of said waveform sample data expressed in said first data representation for said group, and wherein said data reproduction means demodulates the waveform sample data expressed in said second data representation that is read out by said read means, into the PCM representation, using the waveform sample data expressed in said first data representation that is read out therewith.

12. A waveform generation device as defined in claim 11 wherein each said group of the sample points consists of three adjacent sample points.

13. A waveform generation device as defined in claim 11 wherein said waveform sample data expressed in said second data representation for each said group is expressed as a difference value that is based on an average of PCM values of the waveform sample data expressed in said first data representation for said group, and wherein said read means reads out along with said waveform sample data expressed in said second data representation for each said group, the other of said waveform sample data expressed in said first data representation for said group.

14. A waveform generation device as defined in claim 13 wherein each said group of the sample points consists of three adjacent sample points, said waveform sample data expressed in said second data representation corresponds to an intermediate sample point of said three adjacent sample points and said waveform sample data expressed in said first data representation correspond to two sample points on both sides of said intermediate sample point.

* * * * *